US006619507B2

(12) United States Patent
Lassota

(10) Patent No.: US 6,619,507 B2
(45) Date of Patent: Sep. 16, 2003

(54) BEVERAGE DISPENSER WITH DRIP TRAY ASSEMBLY AND METHOD

(75) Inventor: Zbigniew G. Lassota, Long Grove, IL (US)

(73) Assignee: Food Equipment Technologies Company, Inc., Lincolnshire, IL (US)

( * ) Notice: Subject to any disclaimer, the term of this patent is extended or adjusted under 35 U.S.C. 154(b) by 0 days.

(21) Appl. No.: 09/932,562

(22) Filed: Aug. 16, 2001

(65) Prior Publication Data

US 2003/0034359 A1 Feb. 20, 2003

(51) Int. Cl.[7] ..... B67D 1/16
(52) U.S. Cl. ..... 222/108; 222/185.1
(58) Field of Search ..... 222/108, 129.1–129.4, 222/184, 185.1

(56) References Cited

U.S. PATENT DOCUMENTS 3,327,902 A * 6/1967 Alterwitz ..... 222/108
5,305,924 A * 4/1994 Groover et al. ..... 137/377
5,542,572 A * 8/1996 Davis ..... 141/86
5,827,428 A * 10/1998 Chang ..... 210/248
5,960,995 A * 10/1999 Leatherman et al. ..... 137/313
6,189,720 B1 * 2/2001 Gillispie ..... 141/311 A

* cited by examiner

*Primary Examiner*—Joseph A. Kaufman
(74) *Attorney, Agent, or Firm*—James W. Potthast; Potthast & Associates

(57) ABSTRACT

A portable beverage dispenser (10) having a hollow body (22)for retention of a beverage and a faucet (42) with a dispenser base assembly (46) has a removable drip tray assembly (28) slidably mounted to horizontally extending base support members(54, 56) usually used for receipt of drips of beverage from the faucet (42) and a backup drip tray (148) fixedly mounted to the support member beneath the removable drip tray assembly to catch drips when the removable drip tray assembly is removed for emptying and cleaning. The drip tray assembly (28) has a drip sink (68) covered by a grate panel (84) having a plurality of elongate, parallel, grate members each with a pointed peak (98) and a pair of opposed substantially flat sides (100, 102) sloping downwardly away from the peak to guide beverage downwardly away from the peak for retention by the drip plate (84).

29 Claims, 5 Drawing Sheets

BEVERAGE DISPENSER WITH DRIP TRAY ASSEMBLY AND METHOD

BACKGROUND OF THE INVENTION

1. Field of the Invention

This invention generally relates to beverage dispensers of the type having a faucet and more particularly to such beverage dispensers having a body and a base for supporting the body and faucet above a support surface.

2. Discussion of the Prior Art

Beverage dispensers of the type having a hollow insulated body with a top that is substantially closed except for a funnel assembly with an inlet for receipt of beverage into the hollow body and a faucet at the bottom of the body for removing beverage from the body into serving decanters or serving containers such a coffee or tea cups, are well known. In the case of such dispensers used in association with coffee brewers, the dispenser is located beneath the brew basket outlet with the top of the funnel assembly adjacent the brew basket outlet for direct receipt of freshly brewed coffee through the funnel assembly with minimum loss of heat. After completion of a brew cycle, the coffee dispenser is removed from beneath the brew basket and carried to another location remote from the coffee brewer for serving by means of a handle that is pivotally mounted at the top of the body. Another substantially identical, but empty, coffee dispenser is then installed beneath the brew basket of the brewer in lieu of the one just filled, and a new brew cycle is begun. In this way relatively large quantities of coffee or other beverage may be freshly brewed, 1–3 gallons per brew cycle, or otherwise freshly added to the dispenser and then distributed to different serving locations, such as may be distributed around a large banquet hall or restaurant dining room.

Before being moved, the inlet opening of the funnel assembly is closed by a suitable closure member to prevent spillage and loss of heat through the funnel inlet opening. In the case of the one known beverage dispenser, the closure for the funnel inlet opening is carried by the handle to prevent separation of the closure member from the dispenser body and possible loss or misplacement of the closure member. In other dispensers, the closure member is not connected and can be separated from the dispenser body and lost or misplaced.

In association with non-portable dispensers of the type permanently attached to the brewer, it is known to provide a drip tray beneath the faucet. Such drip trays are generally fixed and are generally mounted in front of a counter top upon which the brewer is supported and beneath the faucet. Such permanently mounted drip trays have a sink for containing an accumulation of splashes and drips from the faucet and to drain such accumulations. The sink supports a grate through which the splashes, etc. pass formed of a plurality of parallel grate members.

These grate members are aligned with each other in a direction parallel to a direction from the front to the back of the brewer and generally have a flat or softly rounded cross-sectional profile. It is also know to arrange these grate members with generally flat or softly rounded cross-sectional profile in a direction transverse to the direction from the front to the back of the brewer. The coffee or tea cups or other decanters are rested upon these grates during operation of the faucet and any splashing that may occur that falls upon the grate, itself, is passed through the openings between the parallel grate members. Other splashing that overshoots or undershoots the grade simply falls where it falls—on the floor, on the person drawing the beverage out of the dispenser through the faucet, backwards against the brewer housing or onto the counter. Other splashing occurs between servings if the serving faucet drips despite being in a "closed" position, a circumstance that happens often due to the limited life cycles and high level of use of the faucet in many applications. Often such permanently affixed drip tray assemblies are elongate, rectilinear strips that collect drips from a plurality of serving stations of either single brewers or twin-brewers with two beverage faucets and a hot water faucet for tea. Such drip trays are also used with other types of beverage dispensers such as milk dispensers.

In portable dispensers, such as dispensers especially adapted to receive hot coffee beverage directly from the brewer, as described above, the inventor has observed that it is apparently unknown to provide a built-in drip tray. Know coffee dispensers have a base that does not readily permit the mounting of a drip tray assembly and are also subject to tipping in a forward direction when the handle of the faucet is pulled forward. In some instances, users will try to intentionally tip the dispenser forward in order to speed the delivery of coffee from the faucet. The base of the dispenser does not sufficiently extend beyond the body of the hollow body of the known dispenser to prevent or hinder forward tipping.

Instead of a drip tray, users generally place a cloth or sponge on the counter top, table or other support surface beneath the faucet to absorb and collect splashes and drips. However, these substitutes for a drip tray are unsanitary, unsightly, and not always available. Also, after they become saturated they not longer absorb splashes or keep dry the bottoms of cups and or serving urns that are rested upon their surface during operation of the faucet.

SUMMARY OF THE INVENTION

In accordance with the present invention a beverage dispenser and method are provided to overcome the disadvantages of known beverage dispensers.

This objective is achieved in part by provision in a portable beverage dispenser having a hollow body for retention of a beverage and a faucet mounted to the body adjacent a bottom of the body and extending outwardly from a side of the body, of a dispenser base assembly for supporting the bottom and the faucet above an underlying support surface, having means for supporting the body and faucet mounted to the body above a support surface, a drip tray assembly and means for mounting the drip tray assembly to the supporting means in a location beneath the faucet for receipt of drips of beverage from the faucet.

Preferably, the supporting means includes a pair of support base members attached to the body and extending forwardly of the body on opposite sides of the body, and the drip tray assembly spans a gap between the pair of forwardly extending support base members. Also, the pair of forwardly extending support base members extend forwardly beyond the forward extent of the faucet to increase stability, a faucet guard extends forwardly of the faucet and the pair of legs forwardly extending support members extend forwardly at least to and preferably beyond a forward most extent of the faucet guard. In addition, in the preferred embodiment, the mounting means includes means for removably mounting the drip tray assembly to the supporting means, and the mounting means includes means for releasably latching the drip tray assembly to the supporting means when in an operative position beneath the faucet.

The objective of the invention is also obtained in part by providing in a portable beverage dispenser having a hollow body for retention of a beverage and a faucet mounted to the body adjacent a bottom of the body and extending outwardly from a side of the body, with a dispenser base assembly for supporting the bottom and the faucet above a support surface having an elongate vertical member with a top connected to the body and a bottom for support by the underlying support surface, and an elongate horizontal member with one end connected to the bottom of the base and extending forwardly from the body by an amount approximately equal to one half of the depth of the body.

Preferably, the elongate horizontal member extends from one of a pair of sides of the hollow body and includes another elongate horizontal member extending from another side opposite to the one of the pair of sides of the hollow body in a direction that is generally parallel to the one elongate horizontal member. A drip tray mounted between the one and the other elongate horizontal members.

The object of the invention is also partly achieved by providing an anti-splash drip tray assembly to collect drips of beverage from a faucet of a beverage dispenser having a hollow body for retention of a beverage with a forward section to which the body is mounted, with a drip plate with upwardly extending sidewalls surrounding a plate bottom and an open top, and a grate panel covering the open top and supported above the plate bottom by the upwardly extending sidewalls and having a grate with a plurality of elongate, parallel, grate members each with a pointed peak and a pair of opposed substantially flat sides sloping downwardly away from the peak to guide beverage downwardly away from the peak for retention by the drip plate.

Moreover the objective is acquired by providing in combination with a beverage dispenser having means for storing beverage with a back and a front and a faucet mounted to the front to dispense beverage, a drip plate assembly having a drip plate with upwardly extending sidewalls surrounding a plate bottom and an open top, and a grate panel covering the open top and supported above the plate bottom by the upwardly extending sidewalls and having a grate formed of a plurality of spaced, elongate, parallel, grate members, said elongate grate members extending in a generally lateral direction that is substantially transverse to a direction from the front to the back of the dispenser to direct splashes downwardly into the drip plate.

The objective is also obtained in part by providing a portable beverage dispenser having a hollow body for retention of a beverage and a faucet mounted to the body adjacent a bottom of the body and extending outwardly from a side of the body with a dispenser base assembly for supporting the bottom and the faucet above an underlying support surface having means for supporting the body and faucet monted to the body above a support surface, a drip tray assembly a backup drip tray, and means for mounting the drip tray assembly above the backup drip tray to the supporting means in a location beneath the faucet for receipt of drips of beverage from the faucet.

Preferably, the backup drip tray is permanently attached to the supporting means, and the drip tray assembly is removably attached to the supporting means. The drip tray has a generally planer body with a concavity forming a sink for collection of drops of beverage located generally beneath the faucet. The supporting means includes a pair of support base members attached to the body and extending forwardly of the body on opposite sides of the body, and the drip tray assembly spans a gap between the pair of forwardly extending support base members. The removably mounting means includes means for mounting the drip tray assembly for sliding movement relative to the supporting means from a detached position forward of the supporting means to an operative position in which the drip tray assembly is fully engaged with the supporting means in an operative position beneath the faucet. The support base includes a pair of horizontal, general parallel support members extending forwardly from opposite sides of the body, and means for mounting the backup drip tray to the parallel support members; and means carried by the backup tray for providing underlying support for the drip tray assembly. Also, preferably, the backup drip tray has a pair of parallel rails for providing underlying support for the drip tray assembly. The backup drip tray is fixedly attached to and spans space between the horizontal, generally parallel support members located beneath the faucet.

The objective is also achieved by providing a method cleaning a beverage brewer by performing the steps of removing a removable drip tray assembly to empty and clean the drip tray assembly, catching drips from the beverage brewer with a backup drip tray while the removable drip tray assembly is removed, cleaning any drips from the backup drip tray before reinstalling the removable drip tray assembly, and replacing the removable drip tray assembly after being emptied and cleaned.

Also, achievement of the objective in part is obtained by providing in combination with a beverage dispenser having a body for storing beverage with a back and a front and a faucet mounted to the front to dispense beverage, a drip plate assembly having a drip plate with upwardly extending sidewalls surrounding a plate bottom and an open top, and a grate panel covering the open top and supported above the plate bottom by the upwardly extending sidewalls and having a grate formed of a plurality of spaced, elongate, parallel, grate members with pointed tops, said elongate grate members extending in a direction toward the dispenser body.

BRIEF DESCRIPTION OF THE DRAWINGS

The foregoing advantageous features of the invention will be described in detail and others will be made apparent from the detailed description of the preferred embodiment of the invention that is given with reference to the several figures of the drawing, in which.

DETAILED DESCRIPTION

Figure 1:
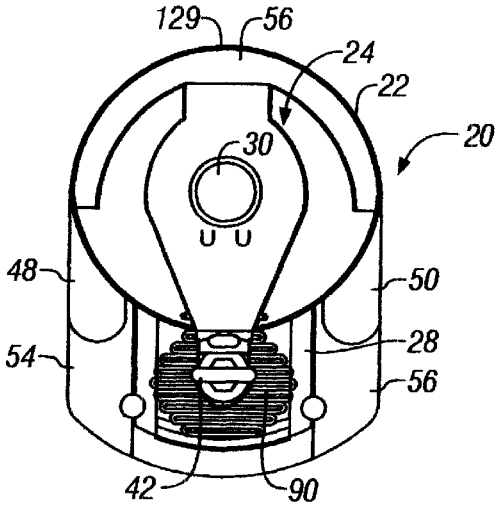
FIG. 1 is a plan view of a preferred embodiment of the beverage dispenser of the present invention showing the drip plate assembly and the relative location of the center of the dispenser body relative to the extent of the anti-tip base assembly.
Figure 2:
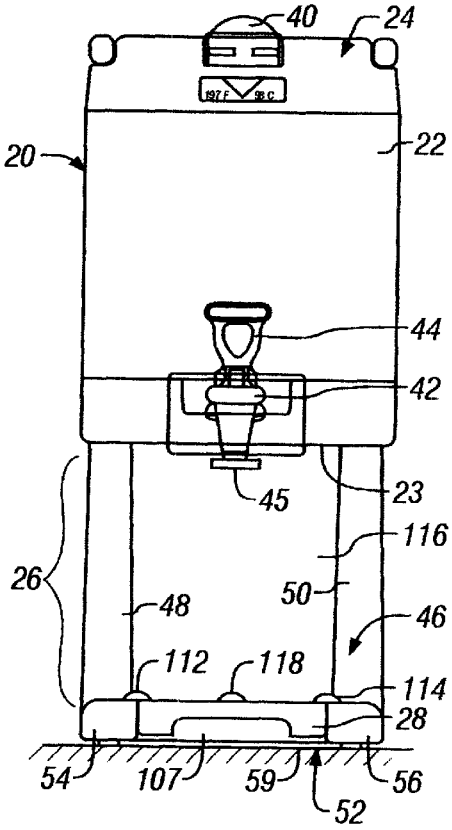
FIG. 2 is a front elevation view of the beverage dispenser of FIG. 1 showing the front of the drip plate assembly in its fully mounted position.
Figure 3:
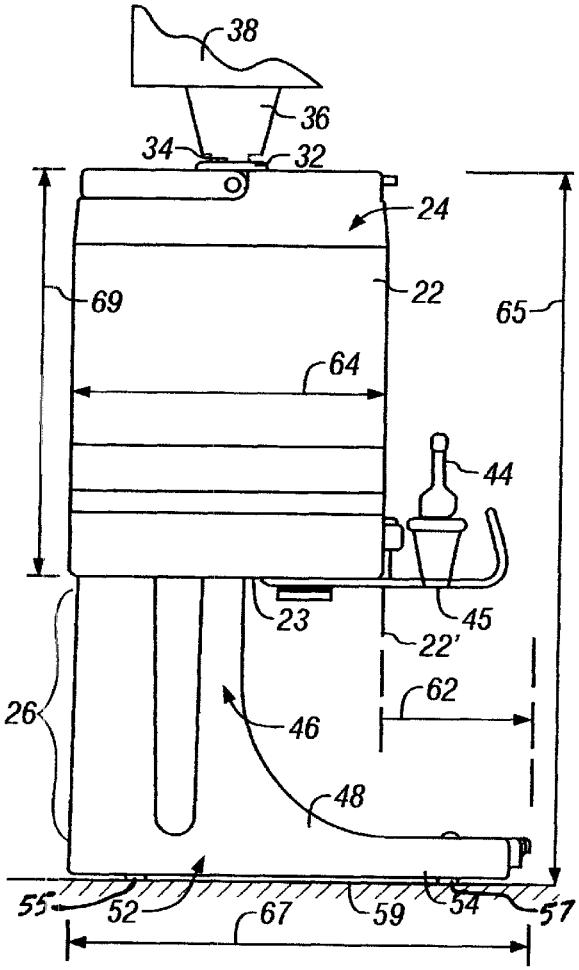
FIG. 3 is a side elevation view of the beverage dispenser of FIGS. 1 and 2 and illustrating again the anti-tip base assembly and the spatial relationship between a brew basket of a brewer and the dispenser during a brew cycle when the beverage container is filled with freshly brewed coffee.

Referring to FIGS. 1, 2, 3 and 4, a beverage dispenser 20, or in this particular case, the hot coffee dispenser, that incorporates the present invention is seen to include an insulated, hollow body 22 with a top cover assembly 24, a base assembly 26 and a drip tray assembly 28. The top cover assembly has a funnel assembly 30 with an inlet opening 32 for receipt of hot coffee directly from the drain hole 34 at the bottom of a brew basket 36 of a mated commercial coffee brewer 38, or the like, as seen in FIG. 3. After the coffee has been brewed directly into the hollow body 22, it is removed from beneath the brewer 38 and the inlet opening 32 is closed with a closure member 40, best seen in FIG. 2. In the case of the invention being embodied in a portable coffee dispenser 20 of FIGS. 1–3, the beverage dispenser 20 is moved to a serving location remote from the brewer 38 or other primary source of the beverage. The coffee is dispensed from the beverage dispenser 20 through a manually operated dispenser valve, or faucet assembly, 42 that has a handle 44 and a dispense outlet 45 connected through a valve operated by the handle 44 to an outlet tube in fluid communication with the interior of the hollow body 22 adjacent the bottom 23 of the body 22.

The base assembly 26 has an elongate vertical leg assembly 46, generally U-shaped in horizontal cross section, that forms a generally continuous surface with the back portion and sides of the cylindrical body 22. The leg assembly 46 includes two forwardly extending parallel leg sections, or legs, 48 and 50, generally tangent with the opposite sides of the dispenser body 22 that lie directly beneath the perimeter of the bottom 23 of the body 22. These legs 48 and 50 are joined to a base 52 that is generally U-shaped in plan view having two, parallel, horizontal base members 54 and 56 that extend forwardly from the bottom of the legs 48 and 50, respectively. Feet 55 and 57 support the base 26 above a support surface 59, such as a serving cart.

Achieving an important object of the invention, the horizontal base members 54 and 56 extend forwardly of the forward most part 22' of the hollow body 22 by an amount, or forward extent, 62 approximately equal to the one half the depth, or diameter, 64 of the hollow body 22 and to provide a base that is more than half of the total height 65 of the entire dispenser 20 and a total base length 67 that is longer than the vertical height, or length, 69 of the approximately equal to the length 66 of the hollow body 22.

In the beverage dispenser 20 of a size to hold a maximum of two gallons of beverage, the diameter is nine inches and the height 69 of the body is 22.15 inches. In the case of the two-gallon size, the forward extent 62 is preferably approximately four inches, or approximately one half of the diameter. It has been determined that with such a forwardly extended base 26, the risk of tipping the body 22 forwardly when the faucet handle is pulled forwardly to dispense beverage is virtually eliminated. Also, intentionally tipping the body forwardly is rendered much more difficult and discourages such unsafe behavior.

Figure 4:
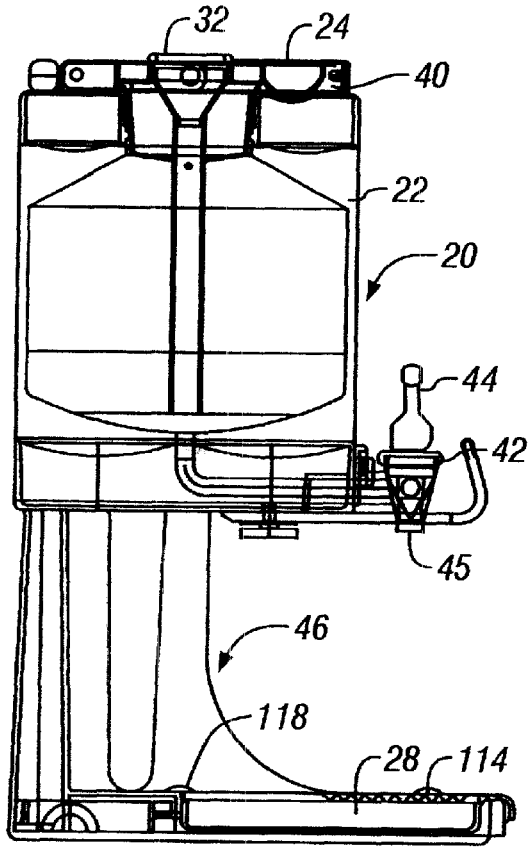
FIG. 4 is a sectional side elevation view of the dispenser of FIG. 3 showing entire beverage dispenser with the drip tray assembly mounted to the anti-tip base assembly.

In addition to making the beverage dispenser 20 safer, the forwardly extending base assembly 26, provides a good support platform for the drip tray assembly 28. While the drip tray assembly 28 could still be mounted to a U-shaped or other shaped base with less than the forward extent 62 needed to reduce tipping risk as described above, in cantilever fashion. However, because of the forward extent 62 of the entire length of the drip tray assembly 28 is provided with underlying support along its entire depth. As seen in FIGS. 1, 2 and 4, the base assembly 26 supports substantially the entire length of the drip tray assembly 28 between the horizontal base members 54 and 56.

Figure 5:
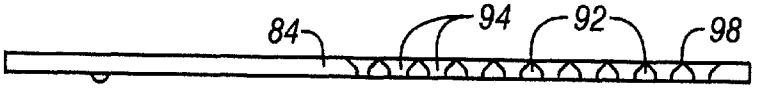
FIG. 5 is a sectional side view of the grate plate of the drip tray assembly when disassembled from the drip plate.
Figure 6:
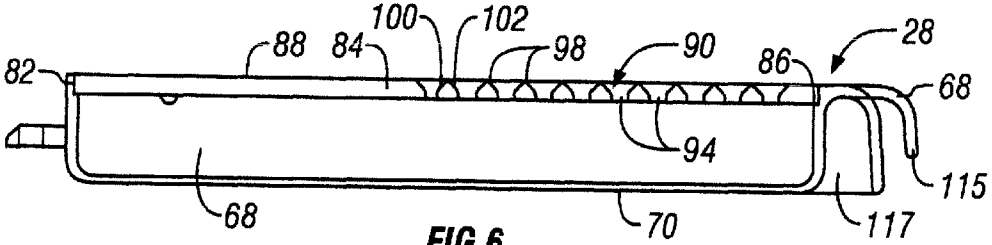
FIG. 6 is a sectional side view of the drip tray assembly with the grate mounted to the drip plate.
Figure 7:
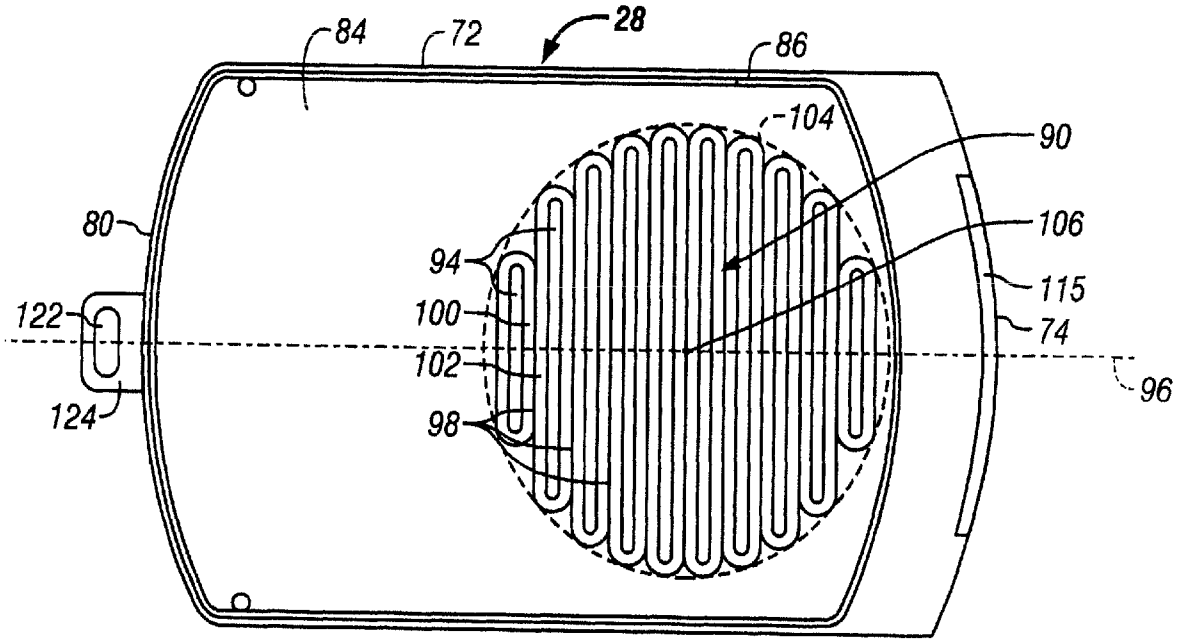
FIG. 7 is a plan view of the drip tray assembly with the grate supported in overlying relationship with respect to the drip plate.

Referring to FIGS. 5, 6 and 7, the drip tray assembly 28, is seen to include a drip plate 68 with a bottom 70, perimeter side walls 72, 74, 78 and 80, and an open top 82, and an anti-splash, anti-wet grate plate 84. A continuous ledge 86 is formed at the tops of the perimeter sidewalls 72–80, and the grate plate 84 is supported around its perimeter by the ledge 86. Depth of the ledge 86 is approximately equal to the thickness of the grate plate 84. Accordingly, when the grate plate 84 is supported by the ledge 86, the top surface 88 of the grate plate 86 is substantially flush with, or beneath, the tops of the side walls 72–80. Achieving an important object of the invention, the grate plate 84 has a grate 90 composed of a plurality of parallel grate members 92 uniformly separated from one another by equal sized parallel gaps 94 that extend in a direction that is transverse to a central, vertical plane of symmetry 96, FIGS. 1 and 7, parallel to a fore and aft direction of beverage dispenser 20. It has been determined that with the grate 90 aligned laterally as shown, splashing is more readily directed laterally and downwardly into the drip plate 68 rather than forwardly toward the operator of the dispenser 20 than when aligned in the opposite fore and aft direction that is customary in known drip trays used with fixed dispenser locations.

The achievement of another advantage of the invention is obtained by provision of the grate 90 in the form of elongate members 92 with pointed peaks 98 formed by intersection planer or concave surfaces 100 and 102 rather than in the customary form of grate members with flat or smoothly rounded tops and convexly curved sides. It has been determined that the sharp peaks 98 break up splashes or drips into smaller droplets that are less inclined to splash upwardly and therefore drain more readily into the drip plate 68 than when the known rounded or flat grate members are used. In addition, there is virtually no pooling of beverage on top of the sharp peaks 98 as can occur with rounded or flat grate members and the peaked grate members 92 of the invention are more resistant to forces tending to inwardly bend or dent the grate members 92. The angle of the peaks is preferably approximately 90-degrees formed by two planer surfaces 100 and 102 extending at an angle of 45-degrees relative to vertical. Different peak angles can be employed so long as the sharp peak remains, but preferably the peak angle is within a range of 60-degrees to 120-degrees. Because the peaks 98 are sharp, when a container is rested upon the grate 90 only a small portion of the bottom of the container comes into contact with the surface of the grate 90 to further reduce wetting even if some wetness remains on the peaks 98.

As best seen in FIGS. 1 and 7, the grate members are sized and arranged into a generally circular pattern 104 with a center 106 of the pattern directly beneath the faucet outlet nozzle 45. A distance from the center to the perimeter of the pattern 104 of approximately 1½ to three inches has been found to be sufficient to catch virtually all splashes and drips on the pattern 104, but smaller patterns could be used with less affect or if the separation between the faucet and the pattern were less than that shown. In any event the pattern 104 should be sufficiently large to provide full support to any serving container contemplated to be used for receipt of beverage being dispensed from the faucet with none of the container extending outside of the pattern 104. By placing the bottoms of containers only on top of the pattern 104, any wetting of the container bottoms is kept to a minimum. The containers only contact the peaks 98 at which there is no pooling and little wetting and thereby are kept from being wetted by the beverage during the dispensing of the beverage from the faucet 42.

Figure 8:
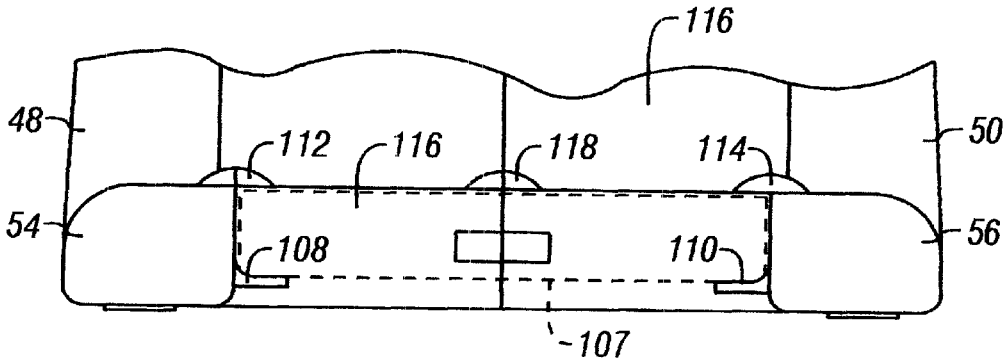
FIG. 8 is an enlarged front elevation view of the bottom portion of the base at which the drip tray assembly is removably mounted.
Figure 9:
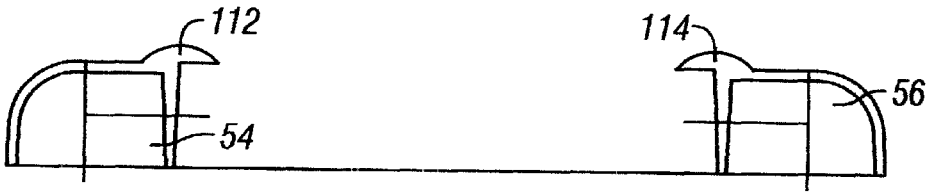
FIG. 9 is a sectional, front elevation sectional view of the forwardly extending base members illustrating upper retention tabs that keep the drip tray in assembled condition when inserted into a mounting pocket between the forwardly extending base members.
Figure 10:
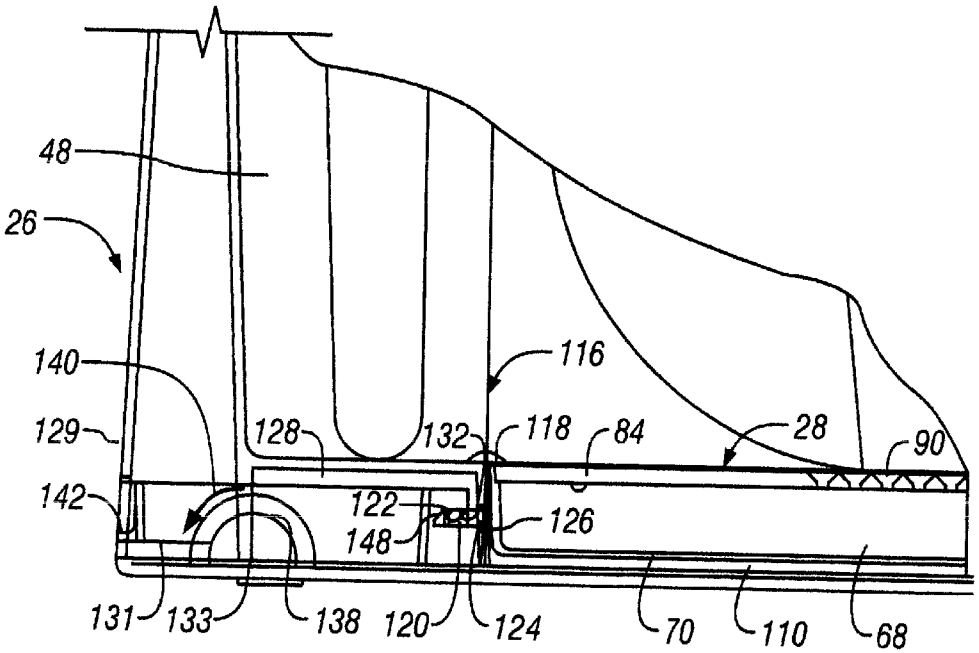
FIG. 10 is an enlarged portion of the FIG. 4 to better illustrate the cross-sectional side elevation view of the drip plate assembly in mounted relationship with the base of the anti-tip dispenser base.
Figure 12:
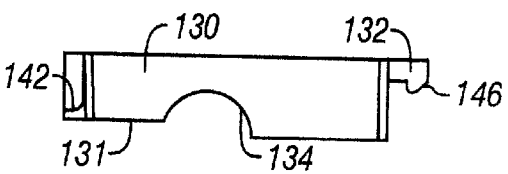
FIG. 12 is a side elevation view of the latch member of FIGS. 10 and 11.
Figure 11:
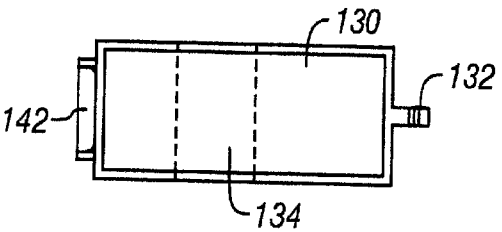
FIG. 11 is a plan view of the drip plate assembly latch member shown in side elevation in FIG. 5.
Figure 13:
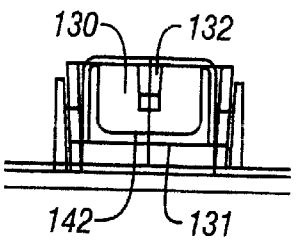
FIG. 13 is another side elevation view of the latch member of FIG. 6 as viewed from one end.

In accordance with another important aspect of the invention, the drip tray assembly 28 is releasable and mounted to the base assembly 26 at a drip tray assembly mounting pocket 107, shown in FIG. 1 and in broken line in FIG. 7, between the base members 54 and 56 to enable removal of the drip tray assembly 28 for cleaning. Referring to FIGS. 8, 9 and 10, the base assembly 26 has a pair of rails 108 and 110 attached to and extending inwardly from the inside surfaces of the base members 54 and 56, respectively. These rails 108 and 110 slidably support the bottom 70 of the drip plate 68 adjacent the opposite sides 72 and 78, respectively. Blocking tabs 112 and 114 mounted to the top of base members 56 and 54 extend inwardly toward each other to overly the grate plate 84 to prevent the grate plate 84 from being separated from the drip plate 68 when the drip tray assembly 28 is inserted between the rails 108 and 110 and the tabs 112 and 114. At the forwardly facing surface 116 of the base assembly 26 centrally located between the pair of base members 54 and 56 at the back of the drip tray assembly pocket 107, shown in broken line in FIG. 7, another retention tab 118 extends forwardly in overlying relationship with the grate plate 84 at the back side 80 of the drip tray assembly 28 to further restrain the drain plate 84 against separation from the drip plate 69. When it is desired to clean the drip tray assembly 28, a handle 115 at the front 74 of the drip plate 84 defined by a U-shaped, downwardly opening, forward extension of the upper drip plate body is used to manually slide the drip tray assembly 28, while assembled, forwardly out of the drip tray assembly mounting pocket 107 until it is free of the retention tabs 112, 114 and 118 and the rails 108 and 110.

Referring now to FIGS. 10, 11, 12 and 13, achieving another object of the invention, when the drip tray assembly 28 is slid into a fully inserted position within the mounting pocket 107, it is automatically latched in position to prevent its unauthorized removal from the pocket 107. The automatically latching is achieved by means of a first latch member 120 with an upwardly facing hook-receptacle 122 at the end of a latch arm 124. When the drip tray assembly is fully inserted into the pocket 107, the latch arm 124 extends through a latch opening 126 located at the front surface 116 of the base 26 between the two forwardly extending base members 54 and 56 and into a latch compartment 128 located between the back surface 129 of the base 26 and the front surface 116 of the base 26 located between horizontal base members 54 and 56. The latch compartment 128 contains a pivotally mounted latch member 130 with a downwardly facing hook 132 that mates with the upwardly facing hook receptacle 122.

The pivotally mounted latch member 132 has a concave, circular pivot surface 134 that is pivotally mounted on top of a mating, convex, circular pivot axle surface 138. The bottom of the pivotally mounted latch member 130 has an undercut 131 to enable pivotal movement in a counter-clockwise direction as indicated by arrow 140 to raise the downwardly facing hook 132 to rise above and out of hooked engagement with the upwardly facing hook-receptacle 122 to unlatch the drip tray assembly 28 when desired. This pivoting is achieved manually by manually pressing down on a latch release handle 142 that is accessable through a latch release opening 144 at the back of the latch compartment 128.

The presence of the undercut 131 and a longer length of the portion of the latch member 130 forward of the pivot axis 133 pivot surface 138 as compared to the length of the portion of the latch aft of the pivot axis 133 places most of the weight of the latch member 130 forward of the pivot axis 138. This weight imbalance causes the latch member 130 to pivot in a clockwise direction when not impeded by a person actuating the latch release handle 42 by engagement with the latch member 120. The hook 132 has a canted cam surface 146 and the hook-receptacle 132 has a mating canted cam surface 148. When the cam surface 146 presses against the cam surface 148 as the drip tray assembly 28 is slide into a fully engaged position in the pocket 107, the hook 132 is cammed upwardly by the cam surface 146 until the uppermost portion of cam surface 148 is passes the lowermost surface of the hook 146, at which time the downwardly facing hook 132 falls into nestled, latched engagement with the upwardly facing hook-receptacle 122. In this way the drip tray is automatically latched into position within pocket 107, but can be manually released from a relatively hidden location behind the beverage dispenser 20 where it cannot be easily seen or accessed by unauthorized persons, such as self-serve customers.

Figure 14:
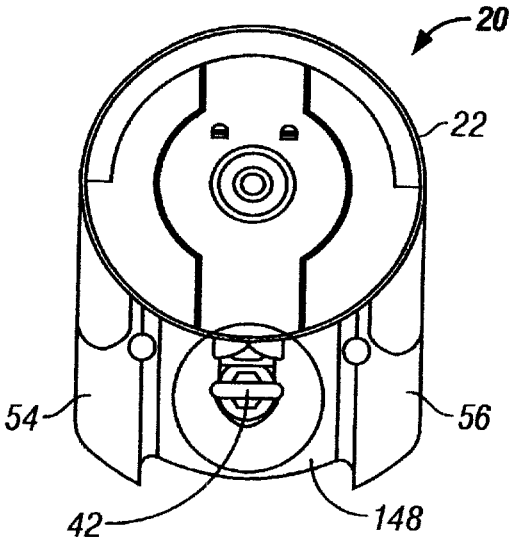
FIG. 14 is a plan view of another embodiment of the beverage dispenser of the present invention in which a backup drip tray assembly is provided and in which the primary drip tray assembly has been temporarily removed.
Figure 15:
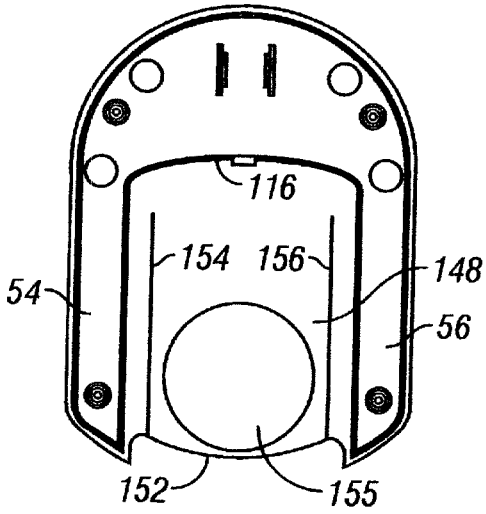
FIG. 15 is a plan view of only the base of the beverage dispenser of FIG. 14 to better illustrate the backup drip tray assembly.
Figure 16:
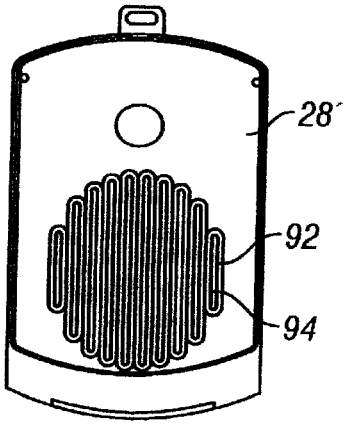
FIG. 16 is a side elevation view of the backup drip tray assembly of FIGS. 14 and 15.

Referring now to FIGS. 14, 15 and 16, another aspect of the invention is embodied in a beverage dispenser 20', which is substantially identical to the dispenser 20 of FIGS. 1–13 except as indicated. Parts of the beverage dispenser 20' that are the same or equivalent to corresponding parts of the beverage dispenser 20 are given the same reference number. Unlike the beverage dispenser 20, the space beneath the faucet 42 and generally the space between the forwardly extending legs 54 and 56 is not vacant when the drip tray assembly 28 is removed from its operative position as shown in FIGS. 1, 2 and 10. When the drip tray assembly 28 is removed, space between legs 54 and 56 is empty as shown in FIGS. 8 and 9. Consequently, when the drip tray assembly 28 is removed temporarily for emptying and cleaning or is misplaced or lost, any drips from the faucet 42 will not be caught by any part of the beverage dispenser and will simply land on the top of the underlying support surface 59. There is no backup drip tray built into the beverage dispenser 20 to catch drips when the primary drip tray assembly 28 is removed.

This relative disadvantage is overcome with the beverage dispenser 20' of FIGS. 14–16. Instead of an empty space, a backup drip tray assembly 148 is provided to catch drips when the drip tray assembly 28 is removed. The backup drip tray assembly 148 has a relatively thin, generally planer support body 150 that extends continuously between the legs 54 and 56 from the back 116 to a forward edge 152 slightly recessed from the forward-most part of the legs 54 and 56 to facilitate insertion and removal of the drip tray assembly 28. Immediately beneath the faucet 42 a round concavity in the planer body 150 defines a backup sink 155. The planer body also carries a pair of elongate, parallel, upraised rails 155 and 156 for sliding underlying support of the bottom of the drip tray assembly 28 when inserted into operative position. Preferably the backup drip tray assembly 148 is permanently attached to and preferably integrally formed with the legs 54 and 56 from a single piece of molded plastic. It should be appreciated that the backup drip tray assembly 148 can be used apart from the drip tray assembly 28 and thus may function as the primary drip tray assembly.

Figure 17:
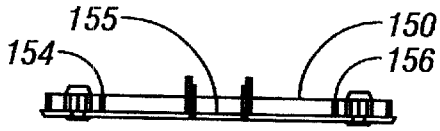
FIG. 17 is a plan view of an alternative embodiment of the drip tray assembly of FIGS. 5–7 in which the direction of the grate members has been changed by ninety degrees.

Referring now to FIG. 17, an alternative form of the removable drip tray assembly 28' is substantially identical to the drip tray assembly 28 except that the elongate gr members 92 and the gaps 94 of the grate plate 84' of the drip tray assembly 28' are aligned in a direction that is parallel to the forward and aft direction of the dispenser and parallel to elongate axis 96. While this may not be as good reducing splashes in the direction of the elongate axis 96, it has been found that because of the use of the splash reducing triangular cross section with sharp peaks 102 for the grate members 92 instead of the customary rounded or flat grate members, the orientation shown in FIGS. 1 and 7, the bottoms of coffee cups or other containers can catch on the grate members 92. Therefore, it may be preferred to use the orientation shown in FIG. 7 only when conventional rounded or flat topped grate members are used, and to use the orientation shown in FIG. 17 when the pointed grate members of the invention as described above with reference to FIGS. 5, 6 and 7 which will still reduce splashing while not causing any catching of cub bottoms when moved out from beneath the faucet 42.

While a particular embodiment has be disclosed in detail for purposes of teaching how to practice the invention, it should be appreciated that many variations may be made without departing from the scope of the invention as defined in the appended claims.

What is claimed is:

1. In a portable beverage dispenser having a hollow body for retention of a beverage and a faucet mounted to the body adjacent a bottom of the body and extending outwardly from a side of the body, the improvement being a dispenser base assembly for supporting the bottom and the faucet above an underlying support surface, comprising:

means for supporting the body and faucet mounted to the body sufficiently above a support surface to enable insertion of a serving cup beneath the faucet and above the underlying support surface including a pair of support base members attached to the body and extending forwardly of the body on opposite sides of the body;

a drip tray assembly; and means for mounting the drip tray assembly to the supporting means in a location beneath the faucet for receipt of drips of beverage from the faucet, the drip tray assembly spanning a gap between and supported at least in part by the pair of forwardly extending support base members.

2. The portable beverage dispenser of claim 1 in which the pair of forwardly extending support base members extend forwardly beyond the forward extent of the faucet.

3. The portable beverage dispenser of claim 1 in which the mounting means includes means for removably mounting the drip tray assembly to the supporting means and above the underlying support surface.

4. The portable beverage dispenser of claim 3 in which the mounting means includes a latch assembly for releasably locking the drip tray assembly against separation from the supporting means when in an operative position beneath the faucet.

5. The portable beverage dispenser of claim 4 in which the drip tray assembly includes an outwardly extending latch member located between the bottom and the underlying support surface, and the base assembly includes another latch member for engagement with the outwardly extending latch member of the drip tray assembly when the drip tray assembly is slid horizontally into in a fully engaged position with respect to the supporting means.

6. The portable beverage dispenser of claim 4 including a latch release actuator for manually disengaging the other latch member and the outwardly extending latch member that is hidden from view from a position forward of the faucet.

7. The portable beverage dispenser of claim 4 in which the outwardly extending latch member extends in a rearward direction from a back end of the drip tray assembly by a sufficient amount to engage the other latch member when the drip tray assembly is slid into supporting connection with the supporting means.

8. The portable beverage dispenser of claim 4 in which the other latch member is pivotally mounted and has a cam surface for engagement by the outwardly extending latch member to pivot the other latch member into a latching engagement position with respect to the outwardly extending latch member.

9. The portable beverage dispenser of claim 4 in which the supporting means includes a vertical support member and the vertical support member has a rearward, vertical base section with a latch support cavity within which the other latch member is mounted and a forward vertical base section with a latch member opening for receipt of the outwardly extending latch member through the opening and into latching engagement with the other latch member.

10. The portable beverage dispenser of claim 3 in which the removably mounting means includes means for mounting the drip tray assembly for sliding movement relative to the supporting means from a detached position forward of the supporting means to an operative position in which the drip tray assembly is fully engaged with the supporting means in an operative position beneath the faucet.

11. The portable beverage dispenser of claim 10 in which the support base includes a pair of horizontal, general parallel support members extending forwardly from opposite sides of the body, and the drip tray assembly has a pair of opposite sides respectively supported by the pair of horizontal support members and spans a space between the pair of support members beneath the faucet.

12. In a portable beverage dispenser having a hollow body for retention of a beverage and a faucet mounted to the body adjacent a bottom of the body and extending outwardly from a side of the body, the improvement being a dispenser base assembly for supporting the bottom and the faucet above an underlying support surface, comprising:

means for supporting the body and faucet mounted to the body above a support surface including a pair of support base members attached to the body and extending forwardly of the body on opposite sides of the body, and in which a drip tray assembly;

the drip tray assembly spans a gap between the pair of forwardly extending support base members;

means for mounting the drip tray assembly to the supporting means in a location beneath the faucet for receipt of drips of beverage from the faucet;

a faucet guard that extends forwardly of the faucet; and in which the pair of forwardly extending support base members extends forwardly at least to a forward most extent of the faucet guard.

13. The portable beverage dispenser of claim 12 in which the pair of forwardly extending support base members extends beyond the forward extent of the faucet guard.

14. The portable beverage dispenser of claim 12 in which the pair of forwardly extending support base members extend forwardly beyond the forward extent of the faucet.

15. The portable beverage dispenser of claim 12 in which the mounting means includes means for removably mounting the drip tray assembly to the supporting means and above the underlying support surface.

16. The portable beverage dispenser of claim 12 in which the mounting means includes a latch assembly for releasably locking the drip tray assembly against separation from the supporting means when in an operative position beneath the faucet.

17. In a portable beverage dispenser having a hollow body with a depth and a height extending between a bottom and a top for retention of a beverage and a faucet mounted to the body adjacent the bottom of the body and extending outwardly from a front of the body, thc improvement being a dispenser base assembly for supporting the bottom and the faucet above a underlying support surface, comprising:

an elongate vertical support member with a top connected to the body and a bottom for support by the underlying support surface with the bottom of the hollow body and the faucet located above the underlying support surface by a sufficient amount to to enable insertion of a serving cup beneath the faucet and above the underlying support surface; and an elongate horizontal member with one end connected to the bottom of the support member and extending forwardly from the front of the body by an amount approximately equal to one half of the depth of the body.

18. The portable beverage dispenser of claim 17 in which the elongate horizontal member extends from one of a pair of sides of the hollow body, and including another elongate horizontal member extending from another side opposite to the one of the pair of sides of the hollow body in a direction that is generally parallel to the one elongate horizontal member.

19. The portable beverage dispenser of claim 18 including a drip tray mounted between and supported at opposite ends by the one and the other elongate horizontal members.

20. In a portable beverage dispenser having a hollow body for retention of a beverage and a faucet mounted to the body adjacent a bottom of the body and extending outwardly from a side of the body, the improvement being a dispenser base assembly for supporting the bottom and the faucet above an underlying support surface, comprising:

means for supporting the body and faucet mounted to the body above a support surface;

a drip tray assembly;

a backup drip tray; and means for mounting the drip tray assembly above the backup drip tray to the supporting means in a location beneath the faucet for receipt of drips of beverage from the faucet.

21. The portable beverage dispenser of claim 20 in which the backup drip tray is permanently attached to the supporting means and the drip tray assembly is removably attached to the supporting means.

22. The portable beverage dispenser of claim 20 in which the drip tray has a generally planer body with a concavity forming a sink for collection of drops of beverage located generally beneath the faucet.

23. The portable beverage dispenser of claim 20 in which the supporting means includes a pair of support base members attached to the body and extending forwardly of the body on opposite sides of the body, and the drip tray assembly spans a gap between the pair of forwardly extending support base members.

24. The portable beverage dispenser of claim 23 in which the mounting means includes means for mounting the drip tray assembly for sliding movement relative to the supporting means from a detached position forward of the supporting means to an operative position in which the drip tray assembly is frilly engaged with the supporting means in an operative position beneath the faucet.

25. The portable beverage dispenser of claim 24 in which the support base includes a pair of horizontal, general parallel support members extending forwardly from opposite sides of the body, and means for mounting the backup drip tray to the parallel support members; and means carried by the backup tray for providing underlying support for the drip tray assembly.

26. The portable beverage dispenser of claim 25 in which the backup drip tray has a pair of parallel rails for providing underlying support for the drip tray assembly.

27. The portable beverage dispenser of claim 26 in which the backup drip tray is fixedly attached to and spans space between the horizontal, generally parallel support members located beneath the faucet.

28. The portable beverage dispenser of claim 26 in which the drip tray assembly includes a grate with elongate grate members that have pointed tops and extend in a direction toward the body of the dispenser.

29. The portable beverage dispenser of claim 25 in which the underlying support means includes a pair of upstanding rails carried by the backup drip tray.

* * * * *